US009506251B2

(12) United States Patent
Gleason

(10) Patent No.: US 9,506,251 B2
(45) Date of Patent: Nov. 29, 2016

(54) AUTOMATIC RETRACTABLE DOWNSPOUT SYSTEM

(71) Applicant: Virgil Gleason, Wayland, MI (US)

(72) Inventor: Virgil Gleason, Wayland, MI (US)

( * ) Notice: Subject to any disclaimer, the term of this patent is extended or adjusted under 35 U.S.C. 154(b) by 0 days.

(21) Appl. No.: 14/987,605

(22) Filed: Jan. 4, 2016

(65) Prior Publication Data

US 2016/0194879 A1 Jul. 7, 2016

Related U.S. Application Data

(60) Provisional application No. 62/100,716, filed on Jan. 7, 2015.

(51) Int. Cl.
*E04D 13/08* (2006.01)
*E04D 13/064* (2006.01)

(52) U.S. Cl.
CPC ..... *E04D 13/08* (2013.01); *E04D 13/0645* (2013.01); *E04D 2013/0846* (2013.01); *E04D 2013/0866* (2013.01)

(58) Field of Classification Search
CPC ..... E04D 13/08; E04D 13/0645; E04D 2013/0866; E04D 2013/0846
See application file for complete search history.

(56) References Cited

U.S. PATENT DOCUMENTS 2,930,392 A * 3/1960 Smith ..... E04D 13/08 137/119.06
3,060,952 A * 10/1962 Bystrom ..... E04D 13/08 137/118.01
3,375,851 A * 4/1968 Schif ..... E04D 13/08 137/120
4,135,540 A * 1/1979 Felsen ..... E04D 13/08 137/360
5,358,007 A * 10/1994 Carlberg ..... E03F 1/002 137/561 A
5,435,051 A 7/1995 Cheremshynski
5,482,084 A * 1/1996 Cassidy ..... E04D 13/08 137/120
5,522,427 A * 6/1996 Johnson ..... E04D 13/08 137/615
5,673,519 A * 10/1997 McCaughan ..... E04D 13/08 137/579
5,735,085 A * 4/1998 Denooy ..... E04D 13/08 137/579
6,219,972 B1 * 4/2001 Zusy ..... E04D 13/0645 137/121
6,240,680 B1 * 6/2001 Estes ..... E04D 13/08 137/615
6,647,670 B1 * 11/2003 Dran ..... E04D 13/0767 137/357
6,701,675 B1 * 3/2004 Ekker ..... E04D 13/08 137/615
6,827,103 B2 * 12/2004 Cheremshynski ..... E04D 13/08 137/615
8,322,083 B1 * 12/2012 Kessler ..... E04D 13/08 137/615
2006/0278573 A1 * 12/2006 Robinson ..... E04D 13/0767 210/460
2009/0126283 A1 * 5/2009 Lucas ..... E04D 13/08 52/16
2010/0126078 A1 * 5/2010 Leahy ..... E04D 13/0645 52/16
2011/0239547 A1 * 10/2011 Port ..... E04D 13/064 52/16

FOREIGN PATENT DOCUMENTS

CA 1022320 A1 12/1977
CA 2096294 10/1998
CA 2276953 A1 * 1/2001 ..... E04D 13/08
CH 673867 A * 4/1990 ..... E04D 13/06
FR 2703708 A1 * 10/1994 ..... E03B 3/02
GB 2234285 A * 1/1991 ..... E03B 3/02

* cited by examiner

*Primary Examiner* — Jeanette E Chapman
(74) *Attorney, Agent, or Firm* — Endurance Law Group, PLC

(57) ABSTRACT

An automatic retractable gutter assembly (10) dispenses rainwater collected in a gutter (14). A short down-tube (26) is attached to the gutter (14). The down-tube (14) has a high relief port (42). A spout (54) is pivotally connected at a fulcrum point (56) to a lower end (32) of the down-tube (14) for articulated movement between closed and deployed positions in response to the absence or presence of rainwater. The spout (54) partially overlies the high relief port (42) when in its closed position, yet exposes a cleaning gap (70) through which a kinetic fluid stream can be directed to back-flush accumulated debris.

20 Claims, 5 Drawing Sheets

AUTOMATIC RETRACTABLE DOWNSPOUT SYSTEM

CROSS REFERENCE TO RELATED APPLICATIONS

This application claims priority to Provisional Patent Application No. 62/100,716 filed Jan. 7, 2015, the entire disclosure of which is hereby incorporated by reference and relied upon.

BACKGROUND OF THE INVENTION

1. Field of the Invention

The invention relates generally to a downspout system for discharging runoff rainwater from a roof surface, and more particularly to an automatic retractable downspout system.

2. Description of Related Art

Precipitation runoff from roofs and other structures must be controlled so as to prevent soil erosion, foundation damage, and seepage. Such runoff water must be conveyed and deposited a safe distance from the structure's foundation or otherwise captured in a cistern or other suitable receptacle. Many attempts to collect and dispense rainwater in a responsible manner have been devised over the years. Among them, a gutter and downspout system has perhaps seen the greatest popularity. Generally, the gutter provides an elongated channel to collect rainwater runoff from a roof. The collected rainwater runs down a hole in the gutter and into a downspout which discharges the water flow through a dispensing spout.

However, most gutter and downspout systems have some drawbacks. Debris, leaves or twigs are often collected with the rainwater in the gutter. A large quantity of accumulated debris will block the flow of water, causing a clog that must be removed. Routine maintenance is therefore needed on most prior art gutter and downspout systems to pro-actively clear accumulations of debris so that a damaging water back-up condition does not develop in the system which could cause water damage below and as well as inside the building structure to which the gutter and downspout system is attached. This problem is often exacerbated in cold climates where stagnated rainwater in the gutter can freeze, and cause ice damming which can lead to very significant structural damage. For these reasons, the typical prior art gutter and downspout system requires frequent attention to avoid debris accumulation and clogging problems.

Another issue with prior art gutter and downspout systems relates to the nuisance factor of the downspout portion and its dispensing spout extending into natural traffic paths around the perimeter of a building structure. Especially in residential applications where access around the house is needed. Consider, for example, a residential home located on a small lot. The dispensing spout that extends from the gutter may need lay on top of the ground nearly to the property line, thereby posing a tripping hazard. Regardless of lot size, it is very often the case that lawn care and/or garden care is required in the vicinity of the downspout portion and its dispensing spout. In these situations, there are many opportunities to inflict damage by collisions with lawn care equipment and/or people. Crushed downspouts and dispensing spouts are common.

And still further, many people express dissatisfaction with the aesthetics of prior art downspout and dispensing spout constructions. So much so, that architectural efforts are often taken to hide or camouflage these components. Expensive options exist that attempt to add design interest to the downspouts and dispensing spouts to remediate their otherwise unsightly appearance. As a corollary to this aesthetics issue, the gutter and downspout systems require periodic painting, usually in color to match the trim elements of the structure. The maintenance factor associated with prior art gutter and downspout systems is therefore compounded.

The prior art has proposed various apparatus to resolve some of these drawbacks. Examples may be seen in U.S. Pat. No. 2,567,004 to William, issued Sep. 4, 1951, and U.S. Pat. No. 3,375,851 to Fitz, issued Apr. 2, 1968. These prior art examples teach the replacement of the traditional static dispensing spout with a retractable spout feature. The spouts automatically deploy when it rains. However, when not in use the spout raises to prevent damage and remove the obstacle to traffic flow. Nevertheless, the prior art systems with retractable spouts are mechanically complicated, thereby increasing costs and likely failure modes. Furthermore, the prior art systems with retractable spouts are prone to clogging by accumulated debris. The complicated mechanical designs, that include many moving parts, increase the necessity for routine periodic maintenance and make clearing clogs more difficult.

There is therefore a need for an improved gutter system that can reduce the required maintenance efforts, that is not prone to clogging, that does not pose an obstruction to traffic around the base of a building structure, that does not detract from the aesthetic appearance of a building structure, and that reduces the normal trim painting requirements.

BRIEF SUMMARY OF THE INVENTION

According to one aspect of this invention, an automatic retractable downspout apparatus is capable of dispensing rainwater collected in a gutter. The apparatus comprises a down-tube that is configured for direct attachment to a gutter. The downtube conducts rainwater in a downward path. The down-tube has an upper end adjacent the gutter and an opposite lower end. The upper end is configured as a water inlet, and the lower end is configured as a water outlet. A spout is pivotally connected at a fulcrum point to the lower end of the down-tube for articulated movement between closed and deployed positions. The spout has a dispensing tip that is collapsed against the down-tube when the spout is in the closed position. In the deployed position, the dispensing tip is extended to disperse water. The spout has a closed bottom defining a basin region that is laterally offset from the fulcrum point when the spout is in the closed position. The basin region is disposed to collect a predetermined tipping volume of rainwater when the spout is in the closed position. A counterpoise is operatively disposed between the spout and the down-tube for continuously applying a counterbalance force to urge the spout toward its closed position. The down-tube includes a high relief port. The high relief port extends from the lower end of the down-tube upwardly to a terminal peak. The spout partially overlies the high relief port when the spout is in the closed position, and the dispensing tip is disposed below the terminal peak of the high relief port to form a cleaning gap. A kinetic fluid stream can be directed through the cleaning gap to back-flush accumulated debris.

The present invention overcomes the disadvantages and shortcomings of the prior art by providing an automatic retractable-deployable spout in combination with a cleaning gap. When the spout is in its closed/retracted position, a person can conveniently remove congregated debris with a jet stream of water or air. When the spout is in its deployed position, as during a rainstorm, the high relief port feature is fully exposed to facilitate the rapid expulsion of debris. The present invention enables a neat and tidy appearance when in the closed position. Furthermore, the ground space below the down-tube and provides clearance for foot traffic and gardening equipment.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
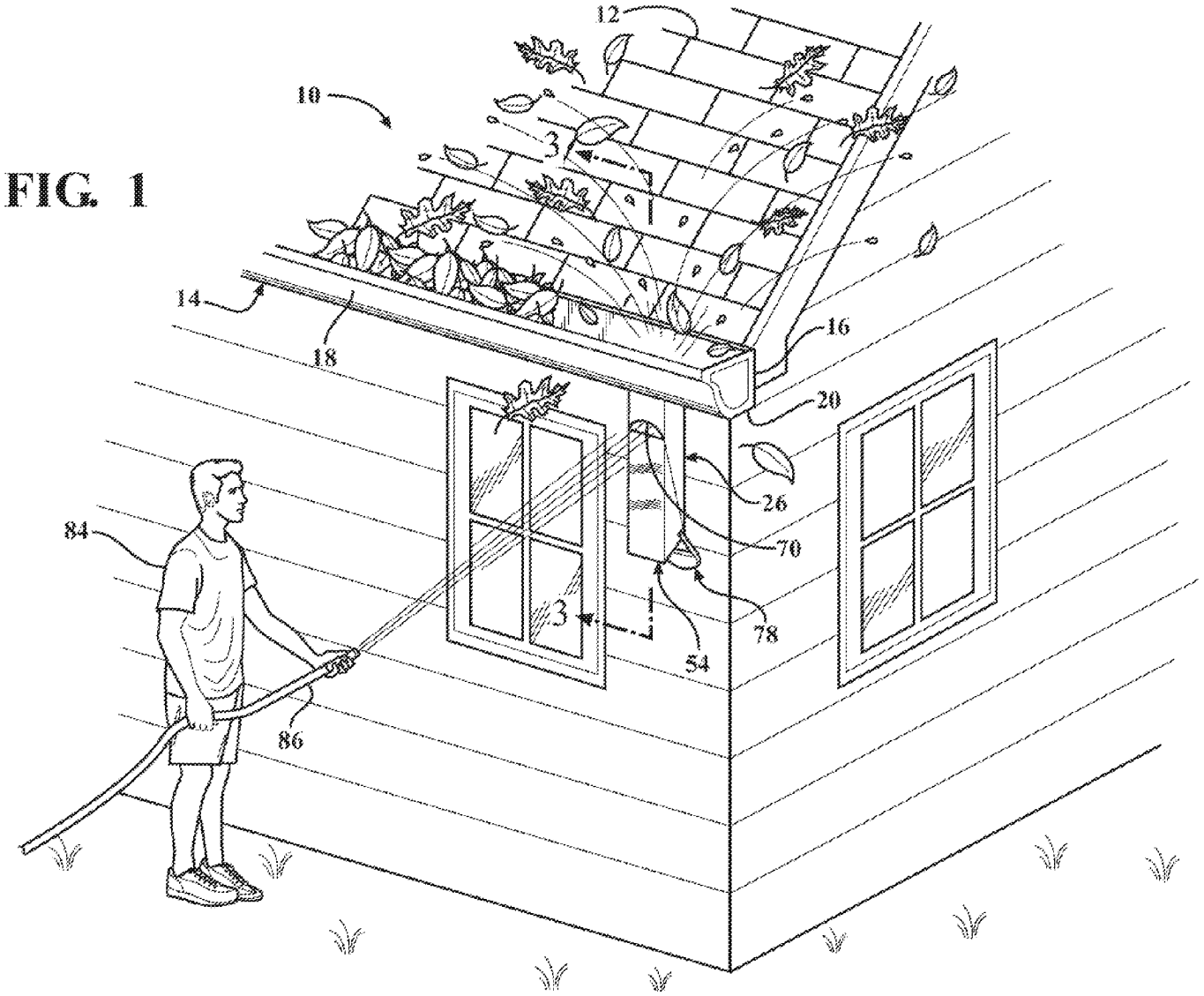
FIG. 1 is a perspective view of an apparatus and methods for an automatic retractable downspout system, wherein the spout is shown in a closed position and a maintenance person is directing a kinetic fluid stream through the cleaning gap to back-flush accumulated debris.

Referring to the figures, wherein like numerals indicate like or corresponding parts throughout the several views, a gutter assembly according to one exemplary embodiment of this invention is generally shown at 10. The gutter assembly 10 is configured for dispensing rainwater collected from the lower edge of a pitched roof 12.

The gutter assembly 10 is illustrated throughout the figures including a trough-like gutter, generally indicated at 14. The trough-like gutter 14 is formed between an elongated rear section 16 and an elongated front section 18. The rear section 16 is typically closest to a house or building over which the roof 12 resides. The front 18 and rear 16 sections extend generally parallel to one another on opposite sides of a floor section 20. The floor section 20, in other words, interconnects the elongated rear section 16 and the elongated front section 18 to form an elongated channel that is adapted to transport rainwater therealong. As shown in the cross-section views of FIGS. 3 and 4, the rear section 16 may adjoin the floor section 20 at a generally right angle, and the front section 18 may adjoin the floor section 20 at an oblique angle so as to form an enlarged open top of the elongated channel to receive rainwater runoff from the surface of the roof 12. In alternative examples, the gutter 14 may be any other configuration, such as semi-circular to name but one. The gutter 14 may also include additional features like a mesh cover, mounting bracketry, or other common features known to those of skill in the art. Furthermore, those of skill in the art will appreciate the many different ways that the gutter 14 may be connected to the house or building adjacent the lower edge of the roof 12, as exemplified in FIGS. 1 and 2.

A hole 22 is formed in the floor section 20 of the gutter 14 for discharging rainwater from its elongated channel. Frequently, but not always, the hole 22 is located near a low end of the gutter 14 so that gravity directs all of the water collected in the gutter 14 to flow toward the hole 22. The hole 22 has a periphery. A drop outlet 24 extends downwardly from the periphery of the hole 22 and is configured to convey the discharged rainwater in a downward path. Preferably, but not necessarily, the hole 22 is generally circular and the drop outlet 24 is generally cylindrical. In alternative examples, the drop outlet 24 may be any other shape, such as rectangular or polygonal. The illustrations suggest that the drop outlet 24 is an integral feature of the floor section 20, however those of skill in the art will appreciate that the drop outlet 24 could be part of a separate piece that is assembled on-site to the elongated portions of the gutter 14. This latter scenario may be more common, especially when the components of the gutter 14 are made from plastic.

The gutter assembly 10 includes a down-tube, generally indicated at 26, as shown in FIGS. 1-5. The down-tube 26 is directly attached to the drop outlet 24 for conducting rainwater in a downward path. In the illustrated examples, the down-tube 26 has a tubular body formed about a generally vertical central axis 28. The central axis 28 passes centrally through the drop outlet 24 and the hole 22 in the gutter 14. The down-tube 26 has an upper end 30 adjacent the gutter 14 and an opposite lower end 32. The upper end 30 is configured as a water inlet disposed to receive rainwater. And the lower end 32 is configured as a water outlet.

The shape of the down-tube 26 can take many possible different forms. In the illustrated examples, the tubular body of the down-tube 26 is generally rectangular in cross-section, as formed by a mostly flat or planar back side 34, front side 36, left side 38 and right side 40. Needless to say, the cross-section of the down-tube 26 may be circular or polygonal or other configuration instead of rectangular. The cross-section of the down-tube 26 may be dictated to a degree by the shape of the drop outlet 24. So for example, if the drop outlet 24 is cylindrical, then perhaps the tubular body of the down-tube 26 is also cylindrical. Or in another example, the shape of the down-tube 26 could be largely decorative to accommodate a user's preference, such as a fluted Greek column or with a spiraling motif.

Regardless of the shape of the tubular body, the down-tube 26 is fashioned so as to include a high relief port 42. The high relief port 42 extends from the lower end 32 of the down-tube 26 upwardly to a terminal peak 44. The terminal peak 44 is shown in the illustrations having a concave curvature, however other shapes are certainly possible including straight across. The high relief port 42 has an inverted and generally U-shaped configuration formed, at least, in the front side 36 of the down-tube 26. In some contemplated variations, the high relief port 42 is entirely formed in the front side 36 of the down-tube 26, such that its periphery is contained in a plane that is generally parallel to the central axis 28. In other contemplated examples, the high relief port 42 appears more like a notch in the front side 36 that cuts with straight vertical lines into the left 38 and right 40 sides of the down-tube 26. However, in the illustrated examples, the U-shaped high-relief port 42 is oriented in a plane skewed relative to the central axis 28. This skewing is the result of the high relief port 42 extending from the front side 36 (at the terminal peak 44) at backward angles intersecting the left 38 and right 40 sides of the down-tube 26. In any configuration, the high relief port 42 creates a relatively large opening in the down-tube 26, with its terminal peak 44 located relatively high above the lower end 32 of the down-tube 26.

In the preferred embodiments, there is a dimensional or proportional relationship between the vertical length of the high relief port 42 and the overall length of the down-tube 26. For cleaning purposes, as will be explained in detail below, the terminal peak 44 is preferably located just below the drop outlet 24 when the down-tube 26 is so connected. This naturally places the terminal peak 44 high about ground level in most applications. Therefore, in order best proportion the down-tube 26, the vertical length of the high relief port 42 is preferably at least one-half the overall length of the down-tube 26. More preferably still, the vertical length of the high relief port 42 is greater than one-half the overall length of the down-tube 26. And in the illustrated examples, the vertical length of the high relief port 42 is approximately equal to three-quarters (i.e., 75%) of the overall length of the down-tube 26. In an example of this latter configuration, if the overall length of the down-tube 26 is about three feet long, then the vertical length of the high relief port 42 will be about two feet three inches, as measured from the lower end 32 to its terminal peak 44.

Figure 3:
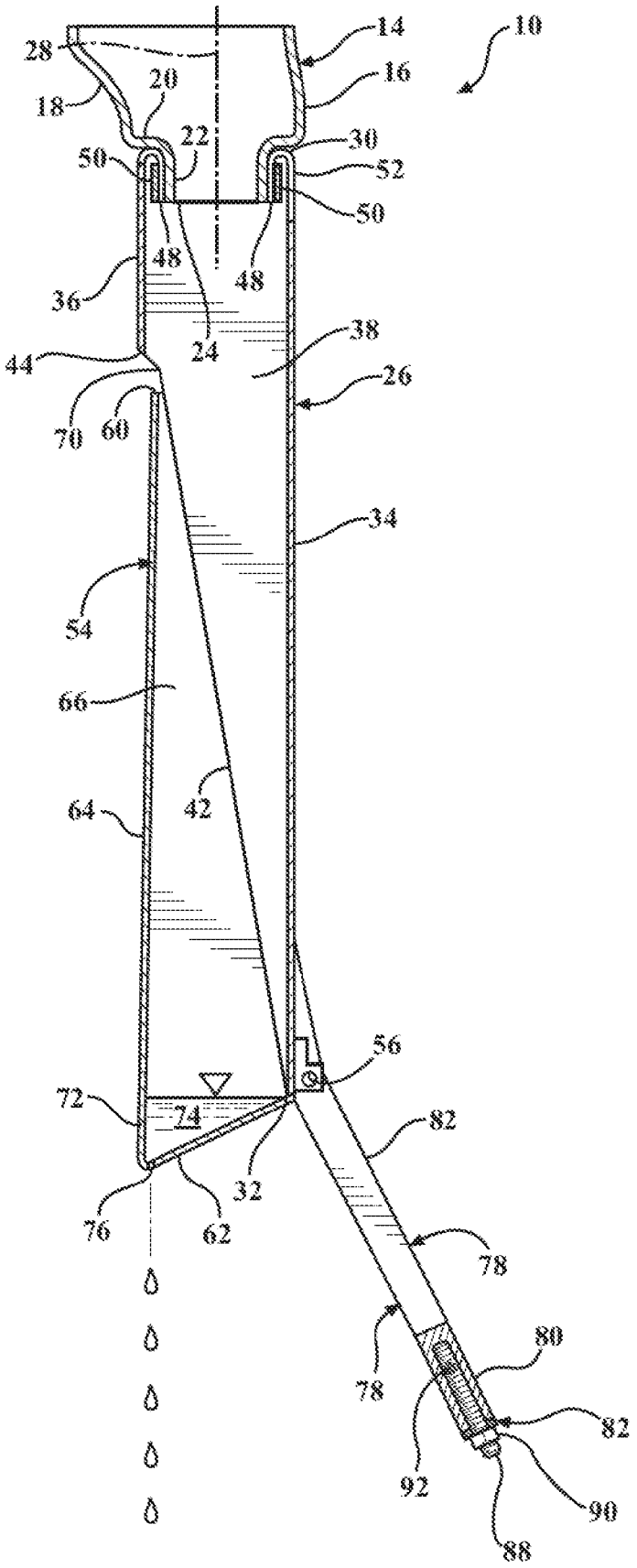
FIG. 3 is a cross-section taken generally along lines 3-3 of FIG. 1.
Figure 4:
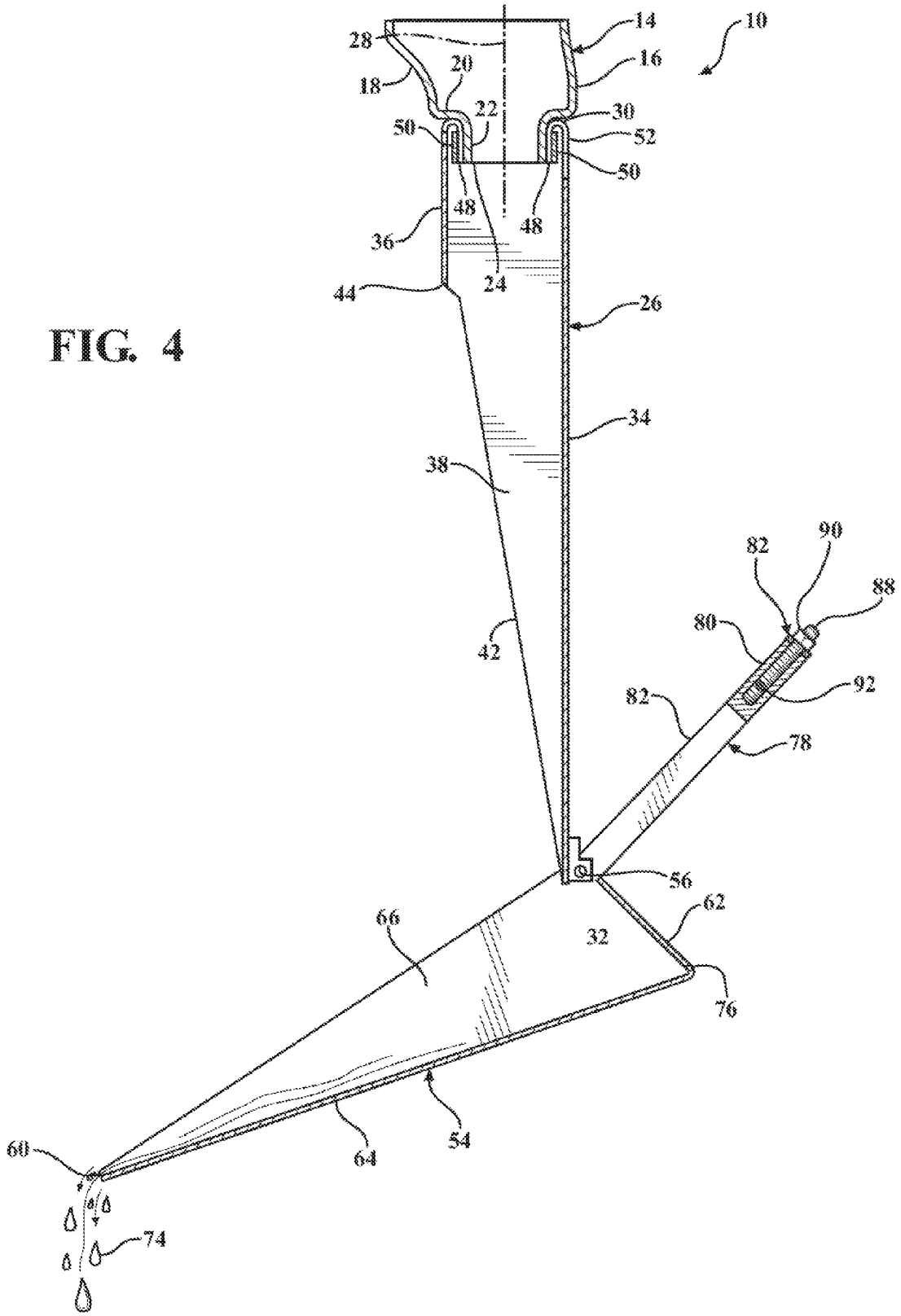
FIG. 4 is a cross-section taken generally along lines 4-4 of FIG. 2.
Figure 5:
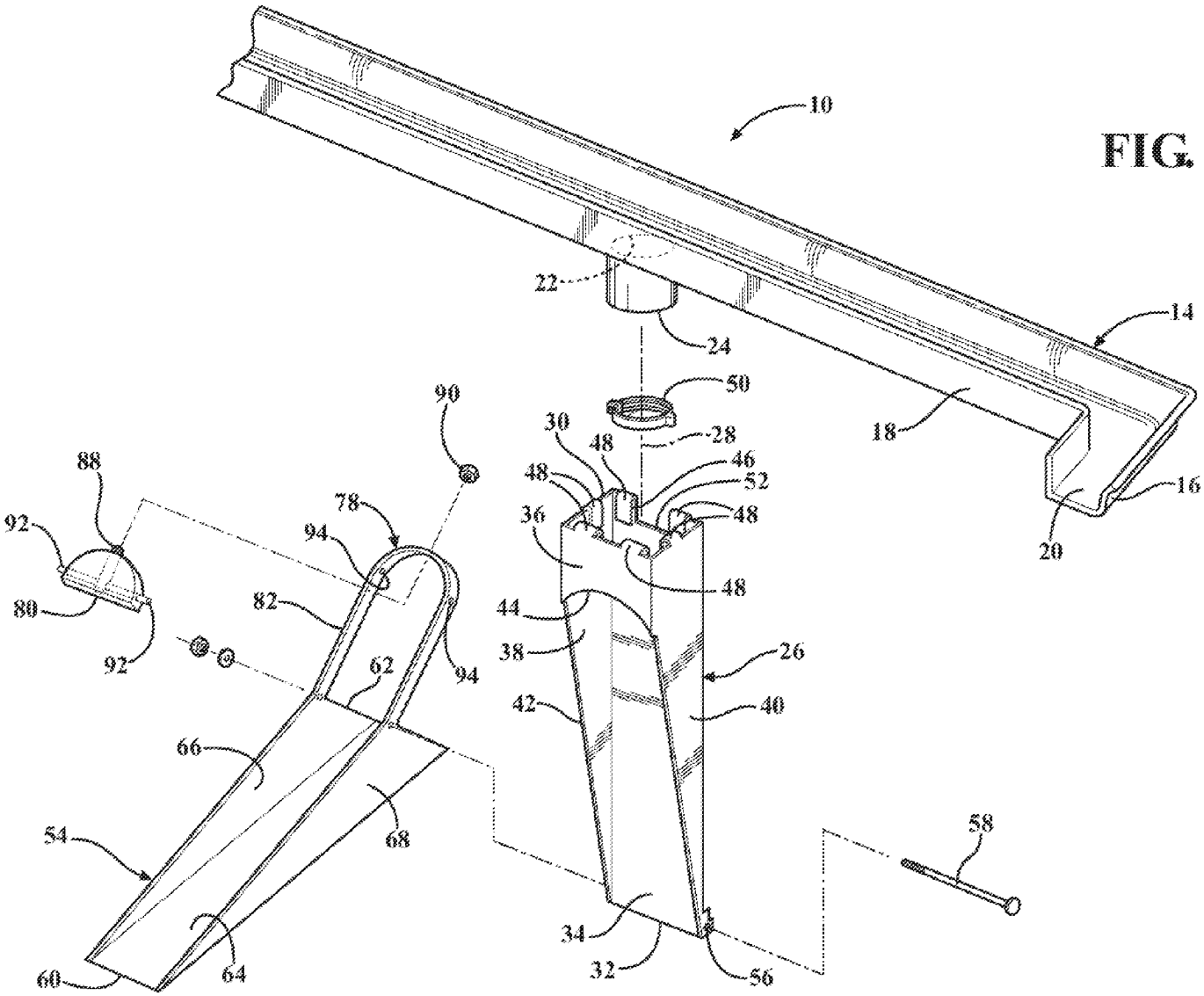
FIG. 5 is an exploded view of a gutter assembly according to one exemplary embodiment of the present invention.

The down-tube 26 further includes a connector 46, which is shown in FIGS. 3-5. The connector 46 is disposed at the upper end 30 of the down-tube 26 for joining the down-tube 26 to the drop outlet 24 of the gutter 14. The connector 46 can be designed in a variety of different ways. For example, a hole for screw or pin or rivet may be used to connect the down-tube 26 to the drop outlet 24. One preferred embodiment of the connector 46 includes a plurality of mounting fingers 48 that are generally centered around the central axis 28. The mounting fingers 48 are formed with an inwardly hooked configuration and adapted to frictionally press with spring-like compression against the drop outlet 24 of the gutter 14. In the illustrated example, the plurality of mounting fingers 48 includes at least one mounting finger extending directly from each of the back 34, front 36, left 38 and right 40 sides of the down-tube 26. However, it will be appreciated that the specific form of the connector 46 is not limited to the plurality of inwardly hooked mounting fingers 48. Perhaps, no connector is necessary to connect between the drop outlet 24 and the down-tube 26, and an interference or press fit or an adhesive method may be applied for a connection.

A clamp 50 may be used to apply a constricting force about the connector 46 of the down-tube 26 to increase frictional engagement with the drop outlet 24 of the gutter 14. That is to say, the clamp 50 can provide a supplemental compressive force on the inwardly hooked mounting fingers 48 to that the down-tube 26 securely grips the drop outlet 24. One preferred embodiment of the clamp 50 comprises a circular band clamp, sometimes referred to as an adjustable hose clamp. As such, the clamp 50 will be driven to tighten the mounting fingers 48 about the drop outlet 24 by turning a threaded fastener. The down-tube 26 has an access port 52 formed in its upper end 30, along its back side 34. The access port 52 is shown in FIG. 5 as being generally rectangular, and located between two of the mounting fingers 48, however other configurations are certainly possible. The purpose of the access port 52 is to provide access to the threaded fastener so that the diameter of the circular band clamp 50 can be adjusted for installation and maintenance. Alternately, the screw-activated clamp 50 may be replaced by a cable tie or other equivalent method.

Figure 2:
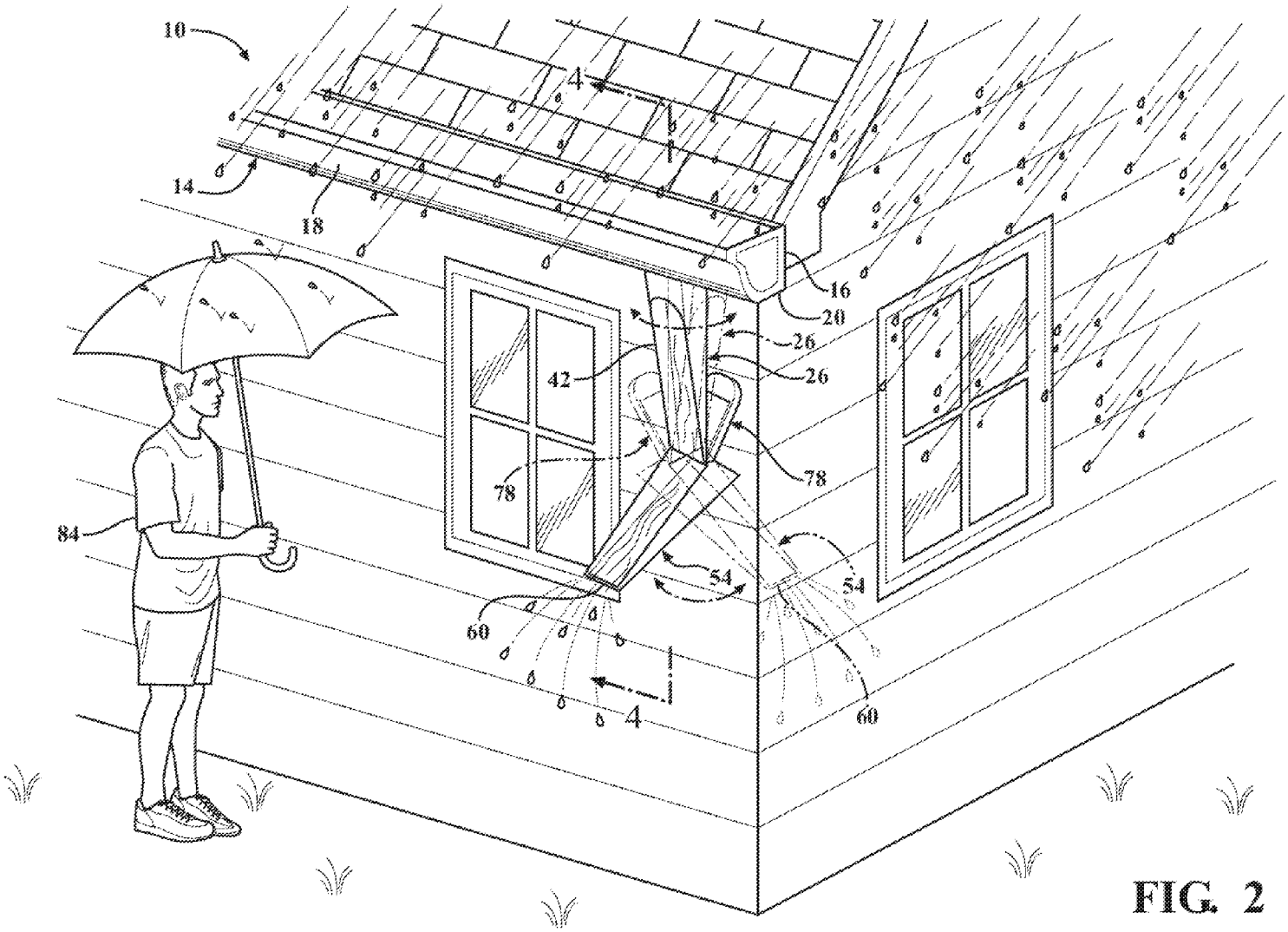
FIG. 2 is a perspective view as in FIG. 1 but showing the spout in a deployed position.

A spout, generally indicated at 54, is pivotally connected to the lower end 32 of the down-tube 26 for articulated movement between closed and deployed positions. The closed position is considered the normal condition of the gutter assembly 10, and the deployed position is a temporary state that occurs automatically when a sufficient quantity of rainwater has accumulated and must be dispensed. Operation of the gutter assembly 10 will be described in detail below. The closed position of the spout 54 is depicted in FIGS. 1 and 3, whereas the deployed position is shown in FIGS. 2 and 4. A fulcrum point 56 between the spout 54 and the down-tube 26 can be located at any suitable location. The spout 54 tips or pivots about the fulcrum point 56 while moving between its closed and deployed positions. In the illustrated embodiments, the fulcrum point 56 is established by a generally horizontal hinge shaft 58 that is located on the back side 34 of the down-tube 26, adjacent the lower end 32. Of course, other mechanical options are available with which to establish a fulcrum, including pins, living hinges, four-bar linkages, sliding interfaces, and the like.

The spout 54 is a somewhat elongated member having a dispensing tip 60 at one end and a closed bottom 62 at its other end. The dispensing tip 60 is spaced most distantly from the fulcrum point 56, whereas the closed bottom 62 is proximate the fulcrum point 56. The dispensing tip 60 is perhaps best shown in the exploded view of FIG. 5 comprising a straight terminal edge. In other contemplated embodiments, however, the dispensing tip 60 could be curved or shaped with flow-controlling vanes or an aerator or other beneficial or aesthetic attributes. The spout 54 may take many different shapes. It is contemplated, however, that the shape of the spout 54 will complement the shape of the down-tube 26 so that when in the closed position, the juxtaposed pair will present a harmonious form. Therefore, in cases where the down-tube 26 is generally rectangular in cross-section, the spout 54 will also be generally rectangular having a front portion 64, and left 66 and right 68 walls. The afore-mentioned closed bottom 62 connects the front portion 64 and the left 66 and right 68 walls into a scoop-shaped construction that is adapted to nest over the down-tube 26 when the spout 54 is in the closed position. That is, when in its closed position (FIGS. 1 and 3), the front portion 64 is generally aligned with the front side 36 of the down-tube 26, and the left wall 66 is generally aligned with the left side 38 of the down-tube 26, and the right wall 68 is generally aligned with the right side 40 of the down-tube 26. It must be understood, however, that the shape of the spout 54 may have other forms—both corresponding with and not corresponding with the shape of the down-tube 26.

The invention includes a cleaning gap 70 through which a kinetic fluid stream can directed to back-flush accumulated debris in the gutter 14. The cleaning gap 70 can take many forms, but in the illustrated examples the cleaning gap 70 is formed between the dispensing tip 60 and the terminal peak 44 of the high relief port 42. When the spout 26 is in the closed position (FIGS. 1 and 3), there is a space between the dispensing tip 60 and the terminal peak 44, revealing the cleaning gap 70. The concave curvature of the terminal peak 44 is spaced apart from the entirety of the dispensing tip 60 when the spout 54 is in the closed position. That is to say, the cleaning gap 70 is the pass-through space that exists between the dispensing tip 60 and the terminal peak 44 of the high relief port 42. Preferably, the cleaning gap 70 is disposed at or near the gutter 14. The shape of the cleaning gap 70 can be varied. In the accompanying illustrations, the cleaning gap 70 has the shape of a segment of a circle, namely the region bounded by the chord-like dispensing tip 60 and the subtended arc of the terminal peak 44, as perhaps best seen in FIG. 1. However, the negative space of the cleaning gap 70 could have a different shape if either or both of the dispensing tip 60 and the terminal peak 44 are shaped differently. In other contemplated embodiments, the cleaning gap 70 may be formed as a cleaning hole in the front portion 64 of the spout 54, or in the front side 36 of the down-tube 26. Such a cleaning hole may have an equivalent function to receive a kinetic jet of water or air.

When the spout 54 is in the closed position, the closed bottom 62 defines a basin region 72 aligned directly below the lower end 32 of the down-tube 26 and laterally offset from the fulcrum point 56, as best shown in the cross-sectional view of FIG. 3. The basin region 72 is capable of collecting a defined volume of rainwater 74, which will be referred to hereafter as a predetermined tipping volume. The basin zone 72 may be provided with one or more weep holes 76 (see FIG. 3) to slowly release any rainwater collected therein and thereby avoid a stagnant pond for mosquitos or growing slime.

The basin region 72 is laterally offset from the fulcrum point 56, such that the weight of the predetermined tipping volume of rainwater 74 creates a torque or a moment about the fulcrum point 56 that urges the spout 54 to rotate toward is deployed position. However, a counterpoise, generally indicated at 78, is operatively disposed with respect to the spout 54 for continuously applying a counterbalance force to urge the spout 54 toward the closed position. When the basin region 72 is empty of water, the counterbalance force, or perhaps more accurately described as a counter-balance torque, is great enough to hold the spout 54 in its closed position. However, when the basin region 72 is filled with rainwater 74, the weight force (or torque) generated by the predetermined tipping volume of rainwater 74 in the basin region 72 is sufficient to overcome the counterbalance force created by the counterpoise 78 thereby automatically tipping the spout 54 toward the deployed position.

The counterpoise 78 could be formed by any number of devices, including springs of all kinds. However, in the illustrated examples, the counterpoise 78 takes the form of a static counterweight attached to the spout 54 adjacent the hinge shaft 58 or fulcrum point 56. As a static counterweight, the counterpoise 78 relies on a mass laterally offset from the fulcrum point 56 by a sufficient distance so that the mathematical product of its mass times its offset distance is generally less than the mathematical product of the density of rainwater 74 times the predetermined tipping volume of rainwater 74 in the basin region 72 times its lateral offset from the fulcrum point 56. Naturally, the static counterweight can also take many different forms. In the preferred embodiment, the counterpoise is fashioned by a detachable weight head 80 that is held at a distant by a least one, but preferably a pair of, counterweight arms 82. The counterweight arms 82 extend rearwardly from the hinge shaft 58 or fulcrum point 56 in a U-shaped arrangement as best seen in FIG. 5. The weight head 80 may be semi-circular so that it seats neatly in the concave region of the U-shaped counterweight arms 82 and is there affixed in place by a projecting stud 88 and nut 90 arrangement. Cross-pins 92 may also be incorporated to secure the weight head 80 in position. The cross-pins 92 snap-fit into corresponding holes 94 in the sides of the counterweight arms 82 to provide a three-point attachment arrangement. Of course, many alternative attachment arrangements are possible. Like a teeter-totter, a moment defined by the length of the counterweight arms 82 times the mass of the weight head 80 on one side is opposed by the mass of water in the basin region 72 times its lateral offset from the fulcrum point 56 on the other side. Whichever side is larger will induce the spout 54 to rotate about the fulcrum point 56.

Turning now to installation and assembly, in use the spout 54 is coupled to the drop outlet 24 using the afore-mentioned clamp 50 or other suitable attachment scheme. The installer may wish to orient the spout 54 so that its dispensing tip 60, when deployed, will point is a preferred direction usually away from the house or building structure. It is contemplated that in situations where there is sufficient clearance, the spout 54 can be rotated around three hundred sixty (360) degrees about the central axis 28 to find a suitable discharge direction, as suggested by the phantom lines in FIG. 2. The installer may wish to adjust the dispersion direction of rainwater for various purposes, such as to harvest rainwater into a reservoir, to aim at a splash block, etc. When the desired orientation is reached, the installer fastens the clamp 50 thru the access port 52 to lock the spout 54 in position.

In most climates where the periods of rainfall are fewer than the periods without rainfall, the spout 54 will be in a normally closed position, as shown in FIG. 1. That is, whenever there is not enough water in the basin region 72 to overcome the counterpoise 78, the spout 54 will automatically position itself in the closed position. Small amounts of water that collect in the basin region 72 will, over time, leak out through the weep holes 76. A person 84 is shown standing on the ground beside the gutter assembly 10. The person 84 may observe that the gutter 14 has accumulated a large quantity of debris, perhaps of leaves or twigs. Such debris will tend to congregate toward the drop outlet 24 as flowing water naturally moves in that direction. When a sufficiently large quantity of debris accumulates around the drop outlet 24, there is a reduced efficiency of the gutter assembly 10. Rainwater will not move as swiftly through the system, leading to overflows of the gutter 14. Left unresolved, the hole 22 for rainwater exit can become completed plugged.

The present invention enables the person 84 to unclog a partially or fully plugged hole 22 without ascending a ladder. Instead, the person 84 can use a well-aimed spray of water via a garden hose 86 or pressure washer (not shown), or an air stream (as from a leaf blower), to back-flush the drop outlet 24. The cleaning gap 70 adjacent to the gutter 14 presents an aiming spot for the water or air jet. The incoming water (or air) stream will pass directly through the cleaning gap 70 with an upward trajectory that causes any debris in the vicinity of the drop outlet 24 to be thrust upwardly, as shown in FIG. 1. The source of the clog is thereby dislodged, allowing the free-flow of water through the hole 22 of the gutter 14, as shown in FIG. 2. The large opening defined by the high relief port 42 further helps to prevent clogs by providing a wide opening through which sticks and other solid debris will readily pass. The large opening of the high relief port 42 also helps to prevent frozen blocks from forming in the down-tube 26 during the winter season.

During a rainstorm, water quickly collects in the basin region 72 to reach the predetermined tipping volume. The moment created by the accumulated mass of rainwater in the basin region 72 overcomes the counter-acting moment of the counterpoise 78 and the spout 54 automatically tips out to the deployed condition (FIGS. 2 and 4). As the water runs down the length of the front portion 64 toward the dispensing tip 60, the moment (or torque) about the fulcrum point 56 is not diminished so that the spout 54 remains in its deployed condition. If the rate of rainfall is sufficiently intense, a continued flow of rainwater through the down-tube 26 will maintain the spout 54 in the deployed condition. When the rate of rainfall is not sufficient to maintain the spout 54 in its deployed condition, the counterpoise 78 will cause the spout 54 to return to its normally closed position. Any small quantities of water that remain trapped in the basin region 72 after the spout 54 automatically retracts to its closed position will slowly exit through the weep hole 76 unless and until new water descending the down-tube 26 enters at a fast enough rate to fill the basin region 72 and cause another tipping event.

Therefore, because the moment generated by the counterpoise 78 is less than the moment created by the predetermined tipping volume of rainwater 74, the spout 54 is automatically deployed and retracted simply by gravity force alone. Once the spout 54 is deployed, the spout 54 will stay in the deployed position as long as a sufficient flow of rainwater from the gutter 14 presses the spout 54 downwardly.

Accordingly, the gutter assembly 10 has many advantages, not least of which include the neat and tidy appearance it affords to a house or building structure to which it is attached. In the closed position, the gutter assembly 10 looks compact, and enables the person 84 to conveniently manage the ground space below the down-tube 26 and provides clearance for foot traffic and gardening equipment. Because of the elevated condition of the gutter assembly 10, human or animal activity is less likely to cause damage to the gutter assembly 10.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. An automatic retractable gutter assembly for dispensing rainwater collected in a gutter, said assembly comprising:

a down-tube configured for direct attachment to a gutter for conducting rainwater in a downward path, said down-tube having an upper end adjacent said gutter and an opposite lower end, said upper end being configured as a water inlet, said lower end configured as a water outlet, a spout pivotally connected at a fulcrum point to said lower end of said down-tube for articulated movement between closed and deployed positions, said spout having a dispensing tip collapsed against said down-tube when said spout is in said closed position and extended to disperse water when said spout is in said deployed position, said spout having a closed bottom defining a basin region laterally offset from said fulcrum point when said spout is in said closed position, said basin region disposed to collect a predetermined tipping volume of rainwater when said spout is in said closed position, a counterpoise operatively disposed between said spout and said down-tube for continuously applying a counterbalance force to urge said spout toward said closed position, and said down-tube including a high relief port, said high relief port extending from said lower end of said down-tube upwardly to a terminal peak, said spout partially overlying said high relief port when said spout is in said closed position, said dispensing tip disposed below said terminal peak of said high relief port when said spout is in said closed position to form a cleaning gap through which a kinetic fluid stream can directed to back-flush accumulated debris.

2. The assembly of claim 1, wherein said down-tube has a tubular body formed about a generally vertical central axis, said tubular body having a front side, and wherein said high relief port is disposed on said front side of said tubular body.

3. The assembly of claim 2, wherein said high relief port has an inverted generally U-shaped configuration oriented in a plane skewed relative to said central axis.

4. The assembly of claim 3, wherein tubular body further includes a back side and a left side and a right side arranged together with said front side in a generally rectangular in cross-section, said high relief port intersecting said front side and said left side and said right side of said tubular body along said inverted and generally U-shaped configuration.

5. The assembly of claim 1, wherein said terminal peak has a concave curvature, said concave curvature of said terminal peak being spaced apart from the entirety of said dispensing tip when said spout is in said closed position.

6. The assembly of claim 1, further including a connector disposed at said upper end of said down-tube for joining said down-tube to the drop outlet of the gutter, said connector including a plurality of mounting fingers.

7. The assembly of claim 6, wherein said down-tube has a tubular body formed about a generally vertical central axis, said plurality of mounting fingers being generally centered around said central axis.

8. The assembly of claim 7, wherein each of said mounting fingers have an inwardly hooked configuration adapted to frictionally press against a drop outlet of the gutter.

9. The assembly of claim 6, further including a clamp for applying a constricting force about said connector.

10. The assembly of claim 9, further including an access port formed in said upper end of said down-tube, said clamp comprising a circular band portion and at least one threaded fastener exposed through said access port in said upper end of said down-tube for adjusting the diameter of said circular band portion.

11. The assembly of claim 10, wherein said tubular body further includes a back side and a front side and a left side and a right side arranged in a generally rectangular in cross-section, said access port disposed in said back side of said tubular body.

12. The assembly of claim 1, wherein said counterpoise comprises a static counterweight attached to said spout adjacent said fulcrum, said counterweight including at least one counterweight arm extending rearwardly from said fulcrum, said counterweight having a detachable weight head supported at a distal end of said counterweight arm, said weight head being generally semi-circular.

13. An automatic retractable gutter assembly for dispensing rainwater collected in a gutter, said assembly comprising:

a down-tube configured for direct attachment to a gutter for conducting rainwater in a downward path, said down-tube having a tubular body formed about a generally vertical central axis, said down-tube having an upper end adjacent said gutter and an opposite lower end, said upper end being configured as a water inlet, said lower end configured as a water outlet, a spout pivotally connected at a fulcrum point to said lower end of said down-tube for articulated movement between closed and deployed positions, said spout having a dispensing tip collapsed against said down-tube when said spout is in said closed position and extended to disperse water when said spout is in said deployed position, said spout having a closed bottom defining a basin region laterally offset from said fulcrum point when said spout is in said closed position, said basin region disposed directly below said lower end of said down-tube to collect a predetermined tipping volume of rainwater when said spout is in said closed position, a static counterweight attached to said spout adjacent said fulcrum for continuously applying a counterbalance force to urge said spout toward said closed position, said counterweight including at least one counterweight arm extending rearwardly from said fulcrum, said counterweight having a detachable weight head supported at a distal end of said counterweight arm, and said down-tube including a high relief port, said high relief port extending from said lower end of said down-tube upwardly to a terminal peak, said spout partially overlying said high relief port when said spout is in said closed position, said dispensing tip disposed below said terminal peak of said high relief port when said spout is in said closed position to form a cleaning gap through which a kinetic fluid stream can directed to back-flush accumulated debris, said high relief port has an inverted generally U-shaped configuration oriented in a plane skewed relative to said central axis.

14. The assembly of claim 13, wherein tubular body of said down-tube comprises a back side and a front side and a left side and a right side arranged in a generally rectangular in cross-section, said high relief port intersecting said front side and said left side and said right side of said tubular body along said inverted generally U-shaped configuration.

15. The assembly of claim 13, wherein said terminal peak has a concave curvature, said concave curvature of said terminal peak being spaced apart from the entirety of said dispensing tip when said spout is in said closed position.

16. The assembly of claim 13, further including a connector disposed at said upper end of said down-tube for joining said down-tube to the drop outlet of the gutter, said connector including a plurality of mounting fingers.

17. The assembly of claim 16, wherein said plurality of mounting fingers are generally centered around said central axis of said down-tube, each of said mounting fingers have an inwardly hooked configuration adapted to frictionally press against a drop outlet of the gutter.

18. The assembly of claim 16, further including a clamp for applying a constricting force about said connector.

19. The assembly of claim 18, further including an access port formed in said upper end of said down-tube, said clamp comprising a circular band portion and at least one threaded fastener exposed through said access port in said upper end of said down-tube for adjusting the diameter of said circular band portion.

20. An automatic retractable gutter assembly for dispensing rainwater from a roof in a controlled manner, said assembly comprising:

a gutter forming an elongated channel adapted to transport rainwater therealong, a drop outlet extending downwardly from said gutter and configured to convey water therethrough, a down-tube directly attached to said drop outlet for conducting rainwater in a downward path, said down-tube having a tubular body formed about a generally vertical central axis, said central axis passing centrally through said drop outlet, said down-tube having an upper end adjacent said gutter and an opposite lower end, said upper end being configured as a water inlet disposed to receive rainwater, said lower end configured as a water outlet, said down-tube including a high relief port, said high relief port extending from said lower end of said down-tube upwardly to a terminal peak, said terminal peak having a concave curvature, said high relief port having an inverted and generally U-shaped configuration oriented in a plane skewed relative to said central axis, a connector disposed at said upper end of said down-tube for joining said down-tube to said drop outlet of said gutter, said connector including a plurality of mounting fingers adapted to frictionally press against said drop outlet of said gutter, an access port formed in said upper end of said down-tube, a clamp for applying a constricting force about said connector of said down-tube to increase frictional engagement with said drop outlet of said gutter, said clamp comprising a circular band portion, said clamp including at least one threaded fastener exposed through said access port in said upper end of said down-tube for adjusting the diameter of said circular band portion, a spout pivotally connected to said lower end of said down-tube for articulated movement between closed and deployed positions, said spout having a fulcrum point laterally offset from said central axis, said spout having a dispensing tip spaced from said fulcrum, a generally horizontal hinge shaft pivotally joining said fulcrum point to said lower end of said down-tube, said spout having a closed bottom defining a basin region below said fulcrum point when said spout is in said closed position, said spout having a front portion disposed against said down-tube when said spout is in said closed position, said front portion extending from said bottom to said dispensing tip, left and right walls disposed on opposing sides of said front portion and adjoining said bottom to form a scoop shape, said front portion and left wall and said right wall arranged in a generally rectangular in cross-section adapted to nest over said tubular body of said down-tube when said spout is in said closed position, said fulcrum disposed adjacent the intersections of said left and right walls with said bottom, said basin region aligned directly below said lower end of said down-tube when said spout is in said closed position to collect a predetermined tipping volume of rainwater therein, said basin zone having at least one weep hole, said spout overlying said high relief port when said spout is in said closed position, said dispensing tip of said front portion disposed below said terminal peak of said high relief port when said spout is in said closed position to form a cleaning gap, said concave curvature of said terminal peak being spaced apart from the entirety of said dispensing tip when said spout is in said closed position, a counterpoise operatively disposed between said spout and said down-tube for continuously applying a counterbalance force to urge said spout toward said closed position, said counterbalance force being less than a weight force generated by said predetermined tipping volume of rainwater in said basin region such that said counterbalance force is overcome when said basin region fills with rainwater thereby automatically tipping said spout toward said deployed position, said counterpoise comprising a static counterweight, said counterweight attached to said spout adjacent said fulcrum, said counterweight including at least one counterweight arm extending rearwardly from said fulcrum, said counterweight having a detachable weight head supported at a distal end of said counterweight arm, said counterweight having a mass, said mass being less than the mathematical product of the density of rainwater times said predetermined tipping volume of rainwater in said basin region.

* * * * *